United States Patent [19]

Kawai et al.

[11] 4,175,507

[45] Nov. 27, 1979

[54] ELECTRONIC IGNITION TIMING CONTROL SYSTEM FOR INTERNAL COMBUSTION ENGINE

[75] Inventors: Hisasi Kawai, Toyohashi; Kazuo Iwase, Okazaki, both of Japan

[73] Assignee: Nippon Soken, Inc., Nishio, Japan

[21] Appl. No.: 847,815

[22] Filed: Nov. 2, 1977

[30] Foreign Application Priority Data

Dec. 17, 1976 [JP] Japan ..... 51/152567

[51] Int. Cl.[2] ..... F02P 1/00; F02P 5/04

[52] U.S. Cl. ..... 123/117 D; 123/148 ND; 123/148 F

[58] Field of Search ..... 123/117 D, 117 R, 146.5 A, 123/148 DS, 148 E, 32 EB

[56] References Cited

U.S. PATENT DOCUMENTS

| | | | |
|---|---|---|---|
| 3,794,008 | 2/1974 | Mathews | 123/146.5 A |
| 3,910,247 | 10/1975 | Hartig | 123/148 DX |
| 3,955,723 | 5/1976 | Richards | 123/117 D |
| 3,998,193 | 12/1976 | Ives | 123/146.5 A |
| 4,009,699 | 3/1977 | Hetzler | 123/117 D |
| 4,015,565 | 4/1977 | Aono | 123/117 D |
| 4,033,305 | 7/1977 | Maioglio | 123/117 D |
| 4,036,190 | 7/1977 | Bigliani | 123/146.5 A |
| 4,086,894 | 5/1978 | Capurka | 123/148 E |

*Primary Examiner*—Jay P. Lucas

*Attorney, Agent, or Firm*—Cushman, Darby & Cushman

[57] ABSTRACT

An electronic ignition timing control system comprises a plurality of double ignition coils each being connected to the spark plugs of each set of two cylinders in a multi-cylinder engine. In addition to a large number of teeth on the periphery of the engine ring gear, there is provided a reference tooth at a predetermined angular crankshaft position for a selected set of the cylinders. The reference angular positions for the other sets of the cylinders are calculated arithmetically. A circuit including read-only-memories determines a desired ignition angle in accordance with engine operating parameters to produce a binary code signal consisting of higher order bits and lower order bits. A first comparator starts to count the number of teeth on the ring gear at the time of the detection of a reference angular position to roughly determine the ignition timing, the first comparator producing an output signal when the count value thereof reaches that of the higher bits. A second comparator starts to count the number of clock pulses of fixed frequency in response to the output signal of the first comparator to finely determine the ignition timing, the second comparator producing an ignition signal when the count value thereof reaches a value corresponding to a fractional ignition angle represented by the lower order bits.

3 Claims, 9 Drawing Figures

ELECTRONIC IGNITION TIMING CONTROL SYSTEM FOR INTERNAL COMBUSTION ENGINE

BACKGROUND OF THE INVENTION

The present invention relates to an electronic ignition timing control system adapted for electronically determining the ignition timing of four cycle internal combustion engines (hereinafter referred to as engines) having four cylinders or more.

The distributors which have heretofore been used generally for determining the ignition timing of engines are so designed that the relative position between the elements of a cam and point or electric contact assembly is varied in accordance with the magnitudes of the engine speed and the intake manifold vacuum to generate an ignition signal at the proper ignition point that suits the engine operating conditions. A disadvantage of this type of devices is that since all the controls are accomplished mechanically, the ignition timing provided cannot be fully reliable and it is also difficult to ensure an ideal ignition timing characteristic, thus giving rise to a problem from the standpoint of exhaust emission control which is now at issue.

Another type of device is known in the art in which a reference position detecting rotor disk is mounted on the shaft of the distributor so that a pickup generates a reference position signal for each cylinder in response to the rotation of the rotor disk, and the point or position at which the reference position signal was generated is utilized as a reference point to electronically determine an ignition timing corresponding to the parameters of an engine, whereby the resulting output is subjected to power amplification by an ignitor to interrupt the ignition coil and the resulting high voltage produced in the ignition coil is distributed through the distributor to the spark plugs of the respective cylinders. A disadvantage of this type of device is that since a high voltage distributing distributor is used, the distribution of high voltage by the discharge of the distributor causes noise wave, and moreover due to the fact that the distributor is driven from the engine through the gear, a play is produced by the backlash of the gear or the like thus causing an error in reference position signals and thereby deteriorating the ignition timing accuracy.

SUMMARY OF THE INVENTION

With a view to overcoming the foregoing deficiencies, it is the object of the present invention to provide an electronic ignition timing control system wherein by detecting a reference position of a four cycle engine having more than one (1+a) cylinders in response to the position of a tooth provided on the ring gear of the engine, starting, in response to the detection of the reference position, the counting of output pulses each generated in response to each of another larger number of teeth on the circumference of the ring gear to determine half as many rotational reference positions as there are the cylinders for every revolution of the engine, utilizing the resulting rotational reference position signals as reference points to electronically determine the correct ignition points and thereby to generate ignition signals and then distributing the ignition signals once for every engine revolution to each of half as many ignitors as there are the cylinders, a high voltage is generated successively in a plurality of double ignition coils adapted to be energized by the ignitors, thus eliminating through the effective utilization of the ring gear the need to especially provide mechanical sensors for discriminating the cylinders, eliminating the use of a high voltage distributing distributor with a simple construction and thereby ensuring reduction of noise wave and improved accuracy of ignition timing.

DESCRIPTION OF THE PREFERRED EMBODIMENT

Figure 1:
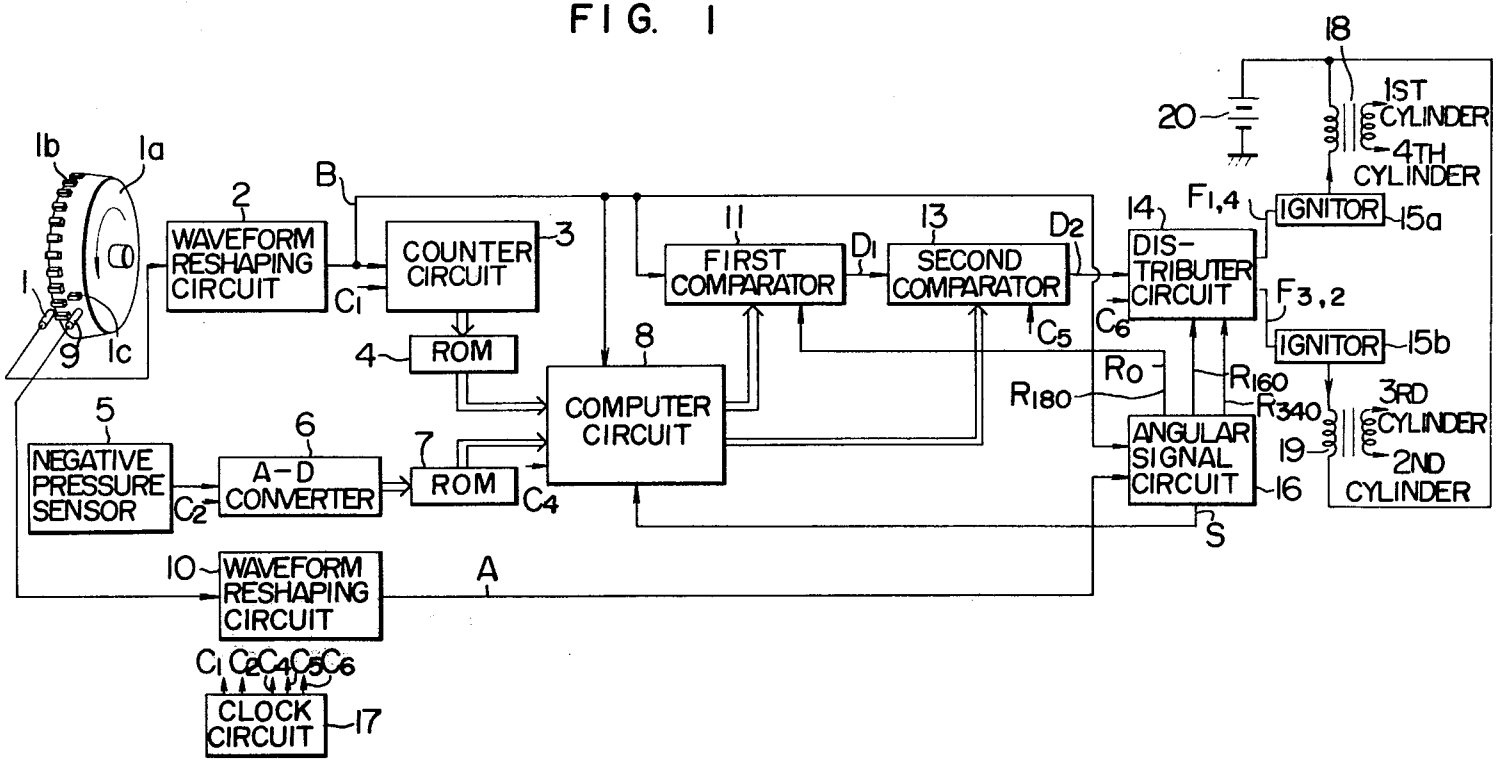
FIG. 1 is a partly schematic block diagram showing an embodiment of an electronic ignition timing control system according to the present invention.
Figure 2A:
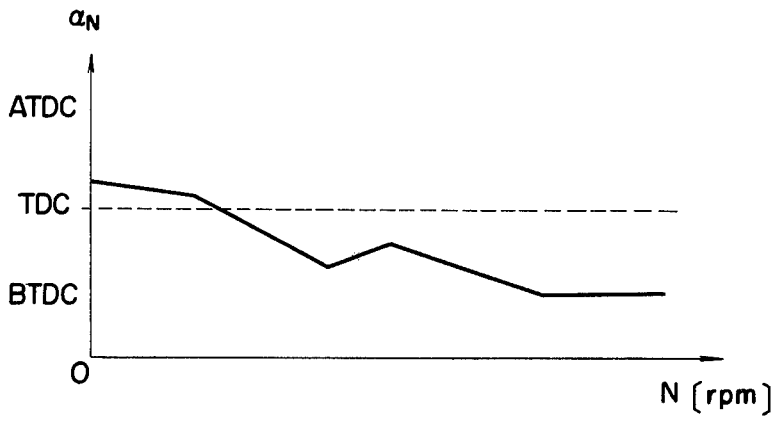
FIGS. 2A and 2B are characteristic diagrams respectively showing the relationship between the engine speed N and the ignition retard angle $\alpha_N$ and the relationship between the negative pressure P and the ignition retard angle $\alpha_P$.
Figure 2B:
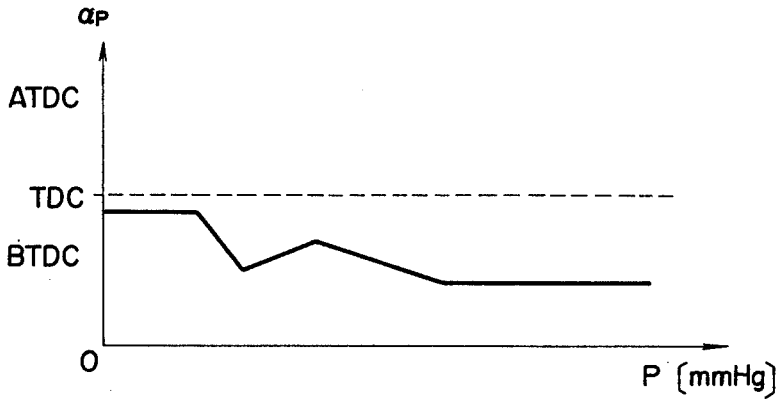

Referring now to FIG. 1 showing the general construction of an embodiment of the present invention, numeral 1*a* designates a ring gear coupled to the shaft (e.g., the crankshaft) of a four-cylinder four-cycle engine which is driven at the same speed as the engine speed and provided with teeth 1*b* arranged at equal spacing to divide the entire circumference into 115 equal parts and a tooth 1*c* corresponding to a rotational reference angle, and 1 an electromagnetic pickup for detecting the teeth 1*b* on the ring gear 1*a*. The detection signal of the electromagnetic pickup 1 will have a frequency of 1150 Hz at the engine speed of 600 rpm. Numeral 2 designates a waveform reshaping circuit of a known type adapted to amplify and reshape the output signal of the electromagnetic pickup 1 into a rectangular wave. Numeral 3 designates a counter circuit responsive to clock pulses $C_1$ from a clock circuit 17 for measuring the time width of the angular signals B from the waveform reshaping circuit 2 and thereby measuring the engine speed N and generating the resulting output in binary code form. Numeral 4 designates a known type of read-only memory (hereinafter referred to as an ROM) which receives the output of the counter circuit 3 as an input address and into which are preliminarily programmed for example the values obtained by dividing the retard angles $\alpha_n$ from the rotational reference angle (60 degrees before the top dead center) in relation to the engine speeds N such as shown in FIG. 2A by the value (3.13°) of the rotational angle signal B in terms of crank angle, and the ROM 4 generates an output in binary code form. Numeral 5 designates a semiconductor negative pressure sensor mounted in the intake manifold of the engine to detect the negative pressure P in the intake manifold and generate an analog voltage. Numeral 6 designates an A-D converter for converting the voltage from the negative pressure sensor 5 into a digital form in response to clock pulses $C_2$ from the clock circuit 17, and it includes a memory circuit and generates an output in binary code form. Numeral 7 designates an ROM which receives the output of the A-D converter 6 as an input address and into which are preliminarily programmed for example the values obtained by subjecting to division and correction the retard angles $\alpha_P$ from the rotational reference angle in relation to the negative pressure P such as shown in FIG. 2B in the similar manner as the angles $\alpha_N$. In FIGS. 2A and 2B, the rotational reference angle (60° before the top dead center) represents a reference point (0°), and symbols TDC, BTDC and ATDC on the ordinate respectively represent the top dead center position, the positions before the top dead center and the positions after the top dead center.

Also in FIG. 1, numeral 9 designates an electromagnetic pickup for detecting the rotational reference angle or the position of the tooth 1c to generate one detection signal for every revolution of the ring gear 1a at the position 60 degrees before the top dead center of the first cylinder. Numeral 10 designates a waveform reshaping circuit identical in construction with the waveform reshaping circuit 2 and adapted to generate a reference angle signal A. Here, it is assumed that $R_0$ represents the position of that tooth 1b of the ring gear 1a which is at or closest in angle on the top dead center side to 60 degrees before the top dead center of the NO. 1 cylinder, and $R_A$ is defined as representing the angle of that tooth 1b which is equal to or smaller than but closest to a retard angle of A degrees from the position $R_0$. For instance, $R_{180}$ represents the angle of that tooth 1b which is equal to or before and closest to 180 degrees in terms of retard angle from the position $R_0$. Thus, it follows that the angle $R_{180}$ is one which is an integral multiple of 3.13 degrees corresponding to the interval between the adjacent teeth 1b on the ring gear 1a. Also in FIG. 1, numeral 16 designates an angular signal circuit for generating, in accordance with the previously mentioned definition, four different angular signals $R_0$, $R_{160}$, $R_{180}$ and $R_{340}$ and a data switching signal S in response to the output signals of the waveform reshaping circuits 2 and 10. Numeral 8 designates a computer circuit wherein the outputs of the ROMs 4 and 7 are combined and the resulting sum is corrected in response to the data switching signal S from the angular signal circuit 16 to produce an output value and apply a predetermined number of its bits to first and second comparators 11 and 13, respectively. The first comparator 11 is reset in response to each of the output signals $R_0$ and $R_{180}$ of the angular signal circuit 16 to start a comparison operation so that when the number of the output pulses generated from the waveform reshaping circuit 2 attains the data from the computer circuit 8, an output signal $D_1$ is generated to reset the second comparator 13. When this occurs, the second comparator 13 starts a comparasion operation so that when the number of clock pulses $C_5$ from the clock circuit 17 attains the output data of the computer circuit 8, an output signal $D_2$ is generated. This output signal $D_2$ is utilized as an ignition signal. Numeral 14 designates a distributer circuit whereby in response to the output signals $R_{160}$ and $R_{340}$ of the angular signal circuit 16, the output signal $D_2$ of the second comparator 13 is distributed to the two cylinder groups respectively including the NO. 1 and NO. 4 cylinders and the NO. 3 and NO. 2 cylinders and at the same time the time width of the output signal $D_2$ is controlled. Numerals 15a and 15b designate ignitors of a known type adapted to respectively power amplify output signals $F_{1,4}$ and $F_{3,2}$ of the distributor circuit 14 to energize double ignition coils 18 and 19. The secondary coil of the double ignition coil 18 is connected to the two spark plugs mounted in the NO. 1 and NO. 4 cylinders, and the secondary coil of the other double ignition coil 19 is connected to the two spark plugs mounted in the NO. 2 and NO. 3 cylinders. Numeral 20 designates a power source battery.

The necessity of the programmed values in the ROMs 4 and 7 being representative of the values obtained by dividing the retard angles $\alpha_N$ and $\alpha_P$ by 3.13 will now be described. Since the electromagnetic pickup 1 utilizes the teeth 1b on the engine ring gear 1a as mentioned previously, if the number of the teeth 1b on the ring gear 1a is 115, then the angular period between the teeth 1b will be given as $360/115 \doteqdot 3.13°$ which corresponds to 3.13° of crank angle. As a result, if the values obtained by dividing the retard angle values $\alpha_N$ and $\alpha_P$ by 3.13 are preliminarily programmed in (m+n) bit binary code form into the ROMs 4 and 7, the higher m bits of the programmed value will correspond to a certain number of the teeth 1b on the ring gear 1a, and consequently by comparing the higher m bits with the number of the teeth 1b passed, it is possible to determine an approximate ignition timing in units of 3.13° through comparison of the angles per se which requires no computing time. This comparison is accomplished in the first comparator 11, so that when the first comparator 11 generates an output signal $D_1$, a fine ignition timing as represented by the lower n bits of the programmed values of the ROMs 4 and 7 is determined by a time width x at that time and this is accomplished by proportion in the computer circuit 8. Assuming that $\theta_O$ represents the lower n-bit value, then it is given as $\theta_O = \alpha_O/3.13$ (where $\alpha_O$ is the actual retard angle value corresponding to the lower n bits). On the other hand, if T represents the period between the teeth 1b, then the time required for 3.13 degrees of rotation is T and the time x corresponding to $\alpha_O$ is given as $x = \theta_O \times T$. Since $\alpha_O/3.13 = \theta_O$ and hence $x = \theta_O \times T$, if the lower n-bit value of the outputs of the ROMs 4 and 7 is multiplied by T, the resulting decimal value represents the fine ignition timing. This product is given in binary code form and converted into a time width by the second comparator 13. Consequently, it is only necessary that the values obtained by dividing the retard angle values $\alpha_N$ and $\alpha_P$ by the angle (3.13°) between the teeth 1b of the ring gear 1a be preliminarily programmed into the ROMs 4 and 7. Here, while the term "retard angle" has been used so far, if a reference position is set for example at 60° before the top dead center, then 40° retard angle corresponds to 20° advance angle in the general sense. As a result, the term "retard angle" means a retard angle from a reference position, and the term "advance angle" means an advance angle in relation to the top dead center. Thus, the same angle may be a retard angle or advance angle depending on the position used as a reference, and therefore the term "advance angle" will be used in the following description.

Figure 3:
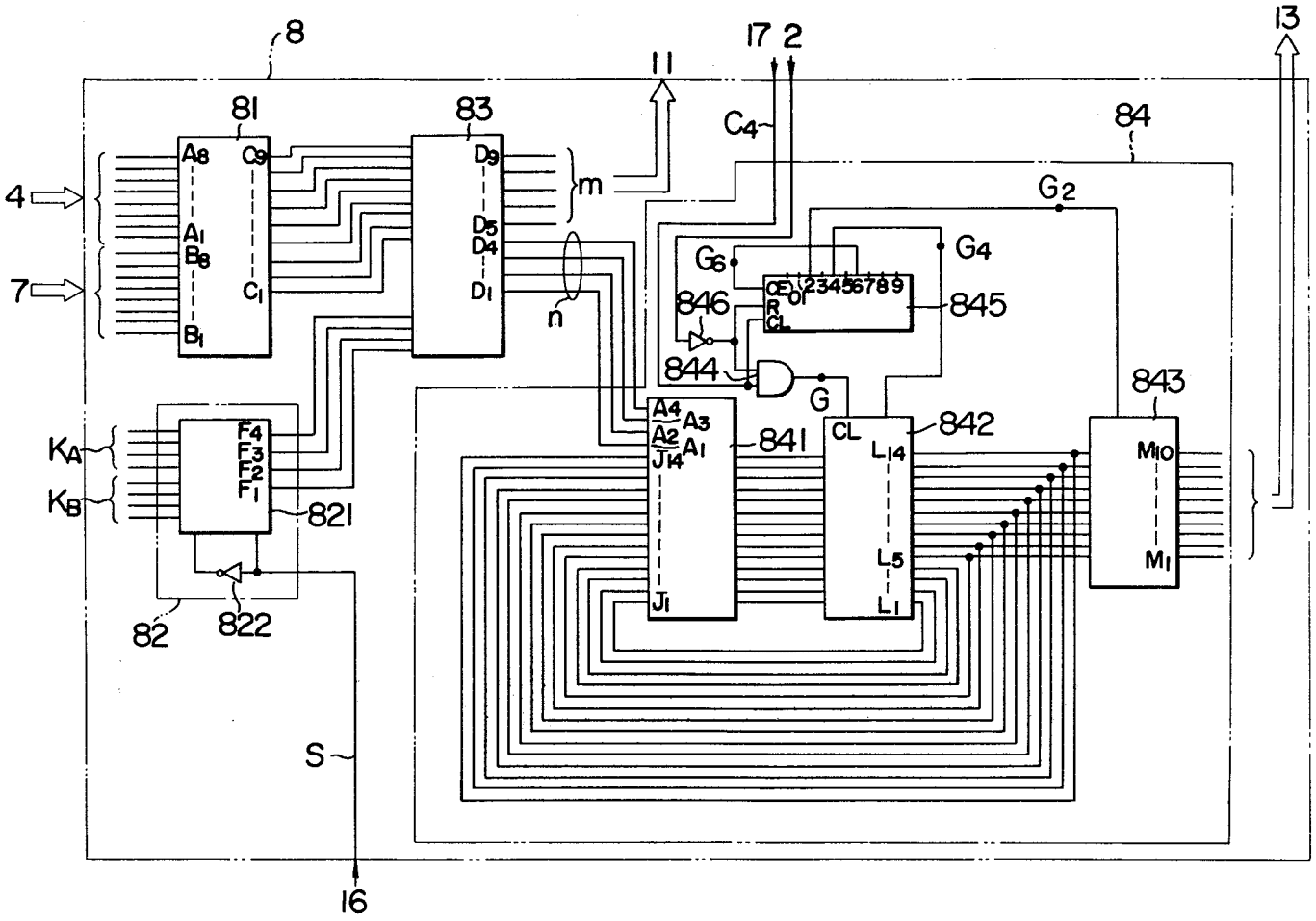
FIG. 3 is a wiring diagram showing a detailed construction of the computer circuit shown in FIG. 1.
Figure 4:
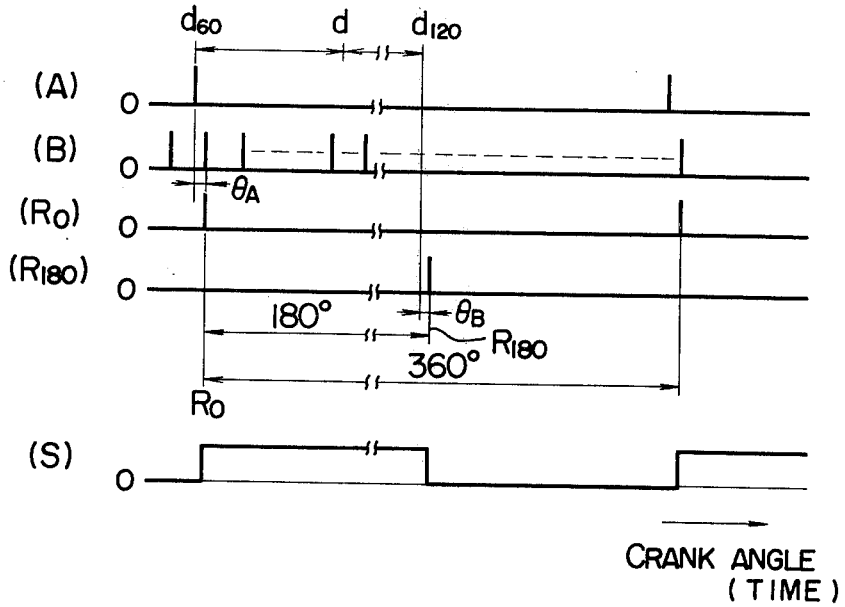
FIG. 4 a signal waveform diagram showing the input and output signals of the angular signal circuit shown in FIG. 1.

Next, the construction of the computer circuit 8 will be described in greater detail with reference to FIG. 3. The computer circuit 8 comprises parallel adders 81 and 83, a data selector circuit 82 and a multiplier circuit 84, and the parallel adder 81 has one of its two input codes, namely, $A_8 \ldots A_1$ connected to the outputs of the ROM 4, the other input code $B_8 \ldots B_1$ connected to the outputs of the ROM 7 and its outputs $C_9 \ldots C_1$ connected to one of the two input codes of the following parallel adder 83 whose other input code is connected to the outputs $F_4 \ldots F_1$ of the data selector circuit 82. The data selector circuit 82 has two input codes which receive respectively binary coded constant values $K_A$ and $K_B$ and its input signal S is applied from the angular signal circuit 16. The parallel adder 83 has its outputs $D_9 \ldots D_5, D_4, \ldots D_1$ divided and connected in two groups, namely, its m bits $D_9 \ldots D_5$ (m=5) are connected to the inputs of the first comparator 11 and the remaining n bits $D_4 \ldots D_1$ (n=4) are connected to the inputs of the multiplier circuit 84. The multiplier circuit 84 receives the angular signals B from the waveform reshaping circuit 2 and clock pulses $C_4$ from the clock circuit 17 as well as the previously mentioned outputs $D_4 \ldots D_1$ of the parallel adder 83, and its outputs are connected to the data inputs of the second comparator 13. The data selector circuit 82 is necessary, because the retard angle must be corrected for two reasons that there always exists an error between the position of the corresponding tooth 1b of the ring gear 1a and the top dead center and that there is an error in the relative mounting position between the electromagnetic pickups 1 and 9. The required amount of correction is constant for the same cylinder. Assume now that the sum of the mounting error of the electromagnetic pickups 1 and 9 and the error between the tooth 1b of the ring gear 1a and the top dead center position results in the waveforms shown in FIG. 4. Shown in (A) of FIG. 4 are the reference angle signals from the waveform reshaping circuit 10 and shown in (B) of FIG. 4 are the rotational angle signals from the waveform reshaping circuit 2. Assuming now that in the Figure d designates the top dead center position of the NO. 1 cylinder and $d_{60}$ designates the position 60° before the position d, the position of the corresponding tooth 1b on the ring gear 1a occurs at the position slightly deviated from the position $d_{60}$ as shown in (B) of FIG. 4. If this angular difference is represented as $\theta_A$, $\theta_A$ has a value which is of course smaller than 3.13°. Of course, strictly the reference angle signal A occurs at the position deviated from the position $d_{60}$ and consequently the actual rotational reference position cannot be satisfactory in the case of the waveform shown in (A) of FIG. 4. Thus, if the position $R_0$ of that ring gear tooth which is retarded but closest to the position $d_{60}$ is used as a reference point, the mounting accuracy of the electromagnetic pickup 9 can be made less severe and it can also be mounted reliably. The differential angle between $R_0$ and $d_{60}$ is the angle $\theta_A$. Thus, since the first comparator 11 performs comparison in response to the signal $R_0$ in ($R_0$) of FIG. 4 as a reference position, the output of the adder 81 representing the total retard angle $\alpha$ must be corrected by an amount corresponding to the angular difference $\theta_A$. Similarly, if the reference position for determining the ignition timing of the NO. 3 and NO. 2 cylinders is set at an angular position 180° behind the position $d_{60}$, namely, if it is assumed that $d_{120}$ represents an angular position 180° behind the position $d_{60}$ or 120° behind the position d and $R_{180}$ represents the position of that tooth 1b of the ring gear 1a which is retarded than but closest to the position $d_{120}$, there of course occurs an error between the positions $d_{120}$ and $R_{180}$ and consequently if this angular difference is represented as $\theta_B$ as shown in ($R_{180}$) of FIG. 4, then the output of the adder 81 representing the total retard angle $\alpha$ must be corrected by an amount corresponding to $\theta_B$. Thus, it is necessary to apply a correction value of $\theta_A/3.13=K_A'$ in determining the ignition timing of the NO. 1 and NO. 4 cylinders and a correction value of $\theta_B/3.13=K_B'$ in determining the ignition timing of the NO. 3 and NO. 2 cylinders. These corrections are accomplished by the data selector circuit 82. In FIG. 3, the signal S from the angular signal circuit 16 is a signal having a waveform as shown in (S) of FIG. 4, so that input data $K_A(1-K_A')$ is delivered as an output $F_4 \ldots F_1$ when the signals S is at a "1" level, and input data $K_B(1-K_B')$ is delivered as an output when the signal S is at a "0" level.

Next, the operation of the computer circuit 8 will be described. The parallel adder 81 produces a sum of the output of the ROM 4 representing a retard angle $\alpha_N$ and the output of the ROM 7 representing a retard angle $\alpha_P$ and the resulting total retard angle $\alpha$ is delivered. The parallel adder 83 produces a sum of the output $C_9 \ldots C_1$ of the parallel adder 81 and the output $F_4 \ldots F_1$ ($K_A$ or $K_B$) of the data selector circuit 82, so that of the resulting output $D_9 \ldots D_1$, the higher five bits $D_9 \ldots D_5$ are applied to the data inputs of the first comparator 11 and the lower four bits $D_4 \ldots D_1$ are applied to the following multiplier circuit 84. The multiplier circuit 84 is so designed that a memory 842 has its outputs $L_{14} \ldots L_1$ connected to the inputs $J_{14} \ldots J_1$ of a parallel adder 841 whose inputs $A_4 \ldots A_1$ are connected to the output $D_4 \ldots D_1$ of the adder 841, and a divider/decade counter 845 stops its counting when it receives 6 clock signals $C_4$. The divider/counter 845 is reset in response to the "1" level of the output signal of an inverter 846 which inverts the output signal B of the waveform reshaping circuit 2, so that at the instant that the output signal goes to the "0" level, clock signals $C_4$ are applied to the divider/counter 845 and the counter 845 generates at its output terminals $G_2$, $G_4$ and $G_6$ "1" level signals $G_2$, $G_4$ and $G_6$ respectively in response to the counting of the second, fourth and sixth clock signals. When the counter 845 counts the fourth clock signal, the memory 842 is reset and its outputs $L_{14} \ldots L_1$ go to 0 . . . 0. Thereafter, in response to each of the clock signals $C_4$ applied through an AND gate 844, the outputs $L_{14} \ldots L_1$ of the memory 842 change to $A_4 \ldots A_1$, $(A_4 \ldots A_1)\times 1, \ldots, (A_4 \ldots A_1)\times n$, and the higher ten bits of the output $(A_4 \ldots A_1)\times n$ are stored as $M_{10} \ldots M_1$ in a memory 843. Since the number n of the clock signals $C_4$ is a value proportional to the period T between the teeth of the ring gear 1a and since the $A_4 \ldots A_1$ is a binary code, the multiplier circuit 84 generates a product $(A_4 \ldots A_1)\times T$ in binary code form. Now considering the bits of the multiplier circuit 84, if the engine speed is 600 rpm, since the number of the teeth on the ring gear 1a is 115, it follows that $600\times 115\times 1/60=1150$ Hz and the period T is given as $T=1/1150 \approx 0.87$ ms. Thus, period T is 0.087 ms when the engine speed is 6000 rpm. Assuming now that the frequency of clock signals $C_4$ is 500 KHz, then the period is 2 μs so that the number of clock signals n is 435 at 600 rpm and 43 at 6000 rpm. Thus, assuming that the input terminals of the adder 841 includes a bit $A_5$ (=16) which is higher than $A_4$ and that the bit $A_5$ is 1 and the other bits $A_4 \ldots A_1$ are all 0s, this corresponds to 3.13° retard angle of the total retard angle in terms of the output of the adder 83. Thus, since $16\times 43$ at 6000, the resulting value of the $L_{14} \ldots L_1$ is 00001010110000. As a result, the output of the memory 843 becomes 0000101011 (=43). Then, when $A_4A_3A_2A_1=0001$, this is about 0.19° in terms of angle, and there results $M_{10} \ldots M_1=0 \ldots 0\ 1\ 0$ (=2) since n=43 at the engine speed of 6000 rpm. Thus, assuming that the frequency of the input clock signals $C_5$ to the second comparator 13 is 500 KHz, an ignition signal is generated at the expiration of 4 μs after the application of a reset pulse. This corresponds to $4\times3.13\div87=0.14°$ of crank angle. This means an error of 0.05°, since the preset retard angle is 0.19° and the actually computed value is 0.14°. While this occurs at the maximum engine speed of 6000 rpm and represents the lowest accuracy, this is a negligible accuracy since the error is 0.05°. Considering now the accuracy of the engine speed, since the minimum step of the ignition timing is at intervals of 2 μs and since 87 μs at 6000 rpm, the number of revolutions at 89 μs is 5865 rpm and the resolution is 2%, whereas since 870 μs at 600 rpm, the number of revolutions as 872 μs is 598 rpm and the resolution is 0.3%.

Figure 5:
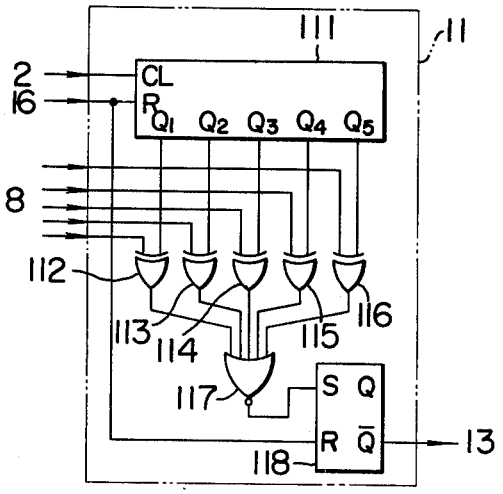
FIG. 5 is a wiring diagram showing a detailed construction of the first comparator shown in FIG. 1.

The first comparator 11 will now be described with reference to FIG. 5. The first comparator 11 comprises a binary counter 111, EXCLUSIVE OR gates 112, 113, 114, 115 and 116, a NOR gate 117 and an R-S flip-flop 118. Consequently, when the binary counter 111 and the R-S flip-flop 118 are reset by the signal $R_0$ or $R_{108}$ from the angular signal circuit 16, the binary counter 111 starts counting the rotational angle signals B applied from the waveform reshaping circuit 2. One pulse period of these signals corresponds to 3.13° of crank angle. When the count value of the binary counter 111 becomes equal to a binary code output corresponding to the higher five bits of the output from the computer circuit 8, the R-S flip-flop 118 is set. The time interval between the instant that the R-S flip-flop 118 is reset and the instant that the R-S flip-flop 118 is set or a "1" is generated at its $\overline{Q}$ output terminal, is proportional to the higher 5-bit output binary code from the computer circuit 8. What is important here is the fact that the time that the output signal at the $\overline{Q}$ output terminal of the R-S flip-flop 118 goes from "1" to "0" corresponds to the retard angle value represented by the higher five bits of the computer circuit 8. In this case, since the input clocks to the first comparator 11 are the output B of the waveform reshaping circuit 2 indicative of the crank angle itself, any variation in the crank rotation during the counting can be directly reflected. The second comparator 13 is identical in circuit construction with the first comparator 11 except that the numbers of counters and EXCLUSIVE OR gates are different depending on the number of input bits. However, it receives as input clock pulses the clock signals $C_5$ of a fixed frequency from the clock circuit 17. The output signal $D_1$ of the first comparator 11 is utilized as a reset signal for the counters and the R-S flip-flop. And it receives as input data the 10-bit output of the computer circuit 8. When the signal from the first comparator 11 goes from "1" to "0," the counters of the second comparator 13 start the counting operating, and the output of the second comparator 13 goes from "1" to "0" when the count of the clock pulses attains the output value of the multiplier circuit 84 adapted to convert the lower 4-bit output value of the adder 83 representing the retard angle value into a delay time value x corresponding to the then current engine speed. Consequently, the time that the comparator output goes from "1" to "0" corresponds to the retard angle represented by the lower four bits of the adder 83 and corresponding to the then current engine speed. The time that the output of the second comparator 13 goes from "1" to "0" indicates the desired ignition point or timing.

Figure 6:
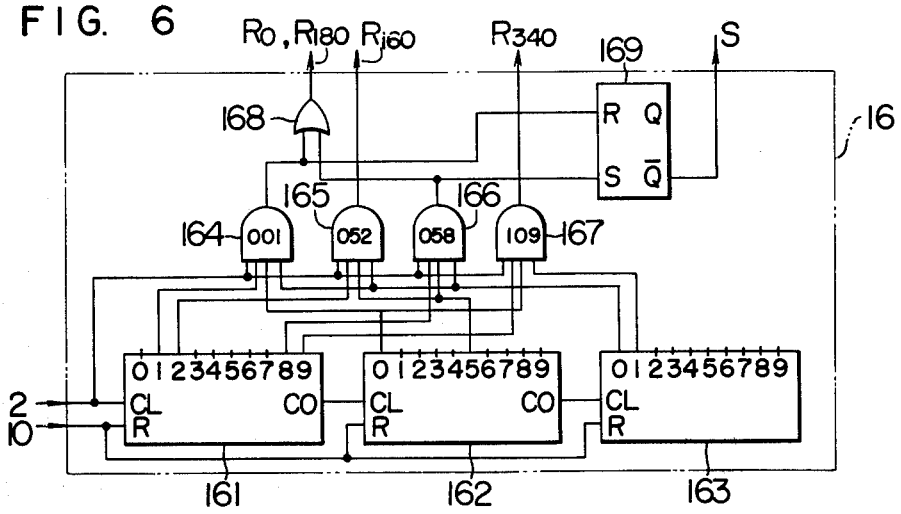
FIG. 6 is a wiring diagram showing a detailed construction of the angular signal circuit shown in FIG. 1.

Next, the angular signal circuit 16 will be described with reference to FIG. 6. The angular signal circuit 16 comprises divider/decade counters 161, 162 and 163, four-input AND gates 164, 165, 166 and 167, an OR gate 168 and an R-S flip-flop 169. The counter 161 has its clock input connected to the output of the waveform reshaping circuit 2 and its reset input connected to the output of the waveform reshaping circuit 10. The counter 162 has its clock input connected to the carry-out terminal of the counter 161 and its reset input connected to the reset input terminal of the counter 161. The counter 163 has its clock input connected to the carry-out terminal of the counter 162 and its reset input connected to the reset input terminal of the counter 161. The counters 161, 162 and 163 are adapted to function as divider/decade counters for 0 to 999. The AND gate 164 is a gate which generates the signal shown in ($R_0$) of FIG. 4 and it has four inputs respectively connected to the input clock terminal and the "1" output terminal of the counter 161 and the "0" terminals of the counters 162 and 163, whereby the signal $R_0$ shown in ($R_0$) of FIG. 4 is generated at the time of generation of the first angle signal B following the generation of a reference angle signal A. The AND gate 165 performs the AND operation on the signals applied from the input clock terminal and the "2" terminal of the counter 161, the "5" output terminal of the counter 162 and the "0" output terminal of the counter 163, and it generates an $R_{160}$ signal at the instant that the 52nd angle signal B is generated. The AND gate 166 performs the AND operation on the signals applied from the input clock terminal and the "8" output terminal of the counter 161, the "5" output terminal of the counter 162 and the "0" output terminal of the counter 163, and it generates the signal shown in ($R_{180}$) of FIG. 4. The AND gate 167 performs the AND operation on the signals applied from the input clock terminal and the "9" output terminal of the counter 161, the "0" output terminal of the counter 162 and the "1" output terminal of the counter 163, and it generates an $R_{340}$ signal at the instant that the 109th angle signal B is generated. The OR gate 168 performs the OR operation on the $R_0$ and $R_{180}$ signals to deliver the $R_0$ and $R_{180}$ signals at its output. The R-S flip-flop 169 has its reset input connected to the output of the AND gate 164 to receive the $R_0$ signal and its set input connected to the output of the AND gate 166 to receive the $R_{180}$ signal, and it generates at its output the signal shown in (S) of FIG. 4. It is to be noted here that the signals $R_0$, $R_{160}$, $R_{180}$ and $R_{340}$ are associated with the corresponding ones of the teeth **1*b* on the ring gear 1*a*, and the signal $R_0$ corresponds to the first tooth 1*b* following the generation of a reference angle signal A. Thus, the angular difference $\theta_A$ between the reference angle signal A and the signal $R_0$ is less than 3.13°. The signal $R_{160}$ corresponds to the 52nd tooth 1*b* and consequently it corresponds to the crank angle of $(52-1)\times3.13°+\theta_A'=159.63°+\theta_A'$. Here $\theta_A'=3.13°-\theta_A$. The signal $R_{180}$ corresponds to the 58th tooth 1*b* and hence the crank angle of $(58-1)\times3.13°+\theta_A'=178.41°+\theta_A'$, and the signal $R_{340}$ corresponds to the 109th tooth 1*b*** and hence the crank angle of $(109-1)\times3.13°+\theta_A'=338.04°+\theta_A'$.

Figure 7:
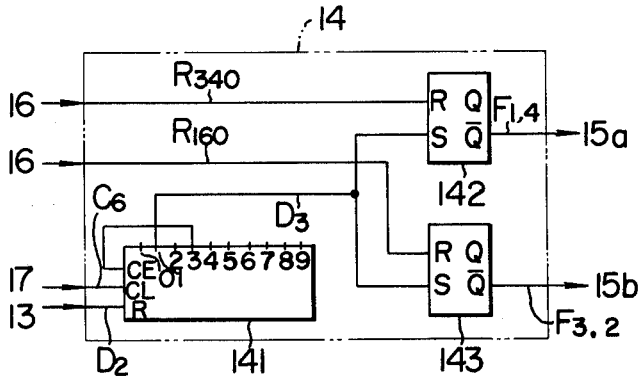
FIG. 7 is a wiring diagram showing a detailed construction of the distributor circuit shown in FIG. 1.
Figure 8:
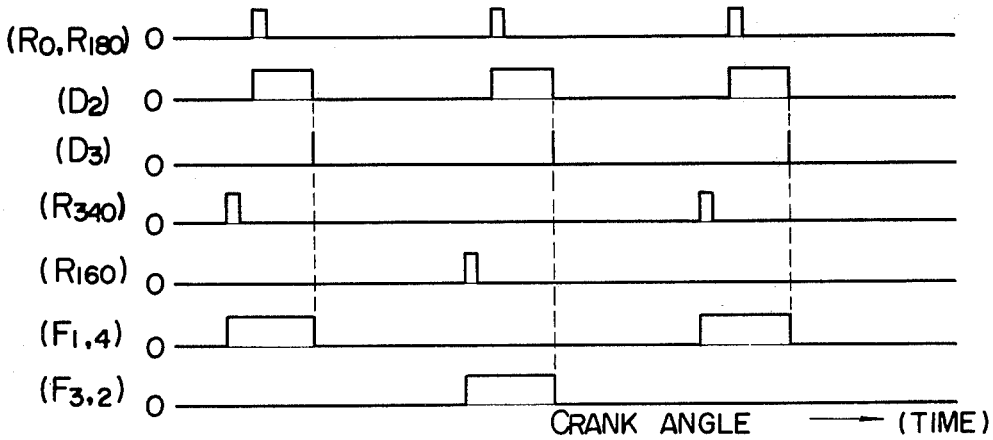
FIG. 8 is a signal waveform diagram showing the input and output signals of the distributer circuit.

Next, the distributer circuit 14 will be described with reference to FIG. 7. The distributer circuit 14 comprises a divider/counter 141 and R-S flip-flops 142 and 143. The divider/counter 141 has its clock input connected to an output $C_6$ (1 MHz) of the clock circuit 17, its reset input connected to the output $D_2$ of the second comparator 13 and its "3" output terminal connected to its clock enable terminal CE to inhibit the counting of more than three clock pulses. The counter 141 also has its "1" output terminal connected to the set terminal S of the R-S flip-flops 142 and 143, respectively. The R-S flip-flop 142 has its reset terminal R connected to the output $R_{340}$ of the angular signal circuit 16, and the R-S flip-flop 143 has its reset terminal connected to the output $R_{160}$ of the angular signal circuit 16. FIG. 8 shows the operating waveforms of the distributer circuit 14. Shown in ($D_3$) of FIG. 8 is the output waveform of the divider/counter 141, and shown respectively in ($F_{1,4}$) and ($F_{3,2}$) of FIG. 8 are the outputs of the R-S flip-flops 142 and 143. The output $F_{1,4}$ represents an ignition signal for the NO. 1 and NO. 4 cylinders, and the output $F_{3,2}$ represents an ignition signal for the NO. 3 and NO. 2 cylinders. The function of the distributer circuit 14 is to adjust the pulse width of the ignition signals and divide the ignition signals into two groups. The signal $F_{1,4}$ is subjected to power amplification by the ignitor 15*a* to energize the double ignition coil 18. Current is supplied to the primary coil of the double ignition coil 18 during the time that the signal $F_{1,4}$ is at the "1" level, and the current supply is interrupted during the time that the signal $F_{1,4}$ is at the "0" level. When the current flow is interrupted, a high voltage is produced in the secondary coil of the ignition coil 18 and this high voltage is directly applied to the spark plugs of the NO. 1 and NO. 4 cylinders, thus producing ignition sparks thereat. The secondary coil of the double ignition coil 18 has its one end connected to the spark plug of the NO. 1 cylinder and its other end connected to the spark plug of the NO. 4 cylinder.

The operation of the double ignition coil and spark plug assembly will be described briefly, although it is well known in the art. In the case of a four-cylinder four-cycle engine, the cylinders are fired in the order of 1, 3, 4, 2, and the NO. 4 cylinder will be on the exhaust stroke when the NO. 1 cylinder is on the compression stroke. The cylinder pressure increases during the compression stroke, but the cylinder pressure does not increase during the exhaust stroke. Consequently, when the high voltage is simultaneously supplied from the double ignition coil 18 to the spark plugs of the NO. 1 and NO. 4 cylinders, the spark plug of the NO. 4 cylinder is immediately short-circuitted and grounded, and the spark plug of the NO. 1 cylinder in which the ignitable mixture is being compressed, receives the high voltage from the double ignition coil 18 and produces an ignition spark. On the contrary, when the NO. 4 cylinder is on the compression stroke and the NO. 1 cylinder is on the exhaust stroke, the spark plug of the NO. 4 cylinder produces an ignition spark. The spark plugs of the NO. 2 and NO. 3 cylinders produce ignition sparks in response to the high voltage from the double ignition coil 19 in the similar firing order as the NO. 1 and NO. 4 cylinders.

This use of double ignition coils eliminates the use of a distributor for mechanically distributing a high voltage to the spark plugs of the respective cylinders.

While, in the embodiment described above, the present invention is applied to a four-cylinder four-cycle engine, the invention can also be applied to any four-cycle engine with six cylinders or more which meets the requirement of more than two (1+a) cylinders (where a is an integer).

Further, while, in the embodiment described above, the engine speed and intake manifold pressure are used as engine parameters, other parameters, e.g., the engine cooling water temperature, exhaust gas quantity, etc., may also be detected to control the amount of ignition advance.

What is claimed is:

1. An electronic ignition timing control system comprising:

rotation angle means for producing a train of rotation pulses each of which is indicative of a predetermined angular rotation of an output shaft of an engine;

reference angle means for producing a reference pulse indicative of a rotation of said output shaft of said engine to a predetermined reference angle;

clock means for producing a train of clock pulses at a fixed frequency;

computing means for computing a desired ignition retard angle in accordance with operating conditions of said engine, said first computing means producing a first output value indicative of a quotient obtained by dividing said ignition retard angle by an angular interval of each of said rotation pulses and a second value indicative of a residual obtained by dividing said ignition retard angle by said angular interval;

converting means for converting said second value produced from said first computing means into a retard time in response to a rotation speed of said output shaft of said engine, said converting means producing a third value indicative of said retard time;

first comparison means for comparing a number of said rotation pulses produced after said reference pulse with said first value produced from said computing means, said first comparison means producing a first comparison output when said number of said rotation pulses reaches said first value;

second comparison means for comparing a number of said clock pulses produced after said first comparison output with said third value produced from said converting means, said second comparison means producing a second comparison output when said number of said clock pulses reaches said third value; and ignition means for producing an ignition voltage in response to said second comparison output.

2. An electronic ignition timing control system according to claim 1, wherein said timing computing means further includes:

a distribution circuit connected to said second comparison circuit and said angular pulse circuit for distributing said second output signal indicative of the ignition timing to said first and second ignition coils in response to said first and second pulses, respectively.

3. An electronic ignition timing control system according to claim 1, wherein said memory circuit includes:

a first memory for memorizing speed retard angles with respect to rotational speed of said multicylinder engine, said speed retard angles being divided by the crank angle between two adjacent teeth of said equi-spaced teeth;

a second memory for memorizing vacuum retard angles with respect to vacuum pressure of said multicylinder engine, said vacuum retard angles being divided in the same manner as said speed retard angles; and an adder circuit for adding said speed retard angles and said vacuum retard angles, thereby determining said ignition retard angles.

* * * * *